United States Patent [19]

Kinnunen

[11] Patent Number: 4,709,732

[45] Date of Patent: Dec. 1, 1987

[54] FOURTEEN HARNESS DUAL LAYER WEAVE

[75] Inventor: Martti I. Kinnunen, Espoo, Finland

[73] Assignee: Huyck Corporation, Wake Forest, N.C.

[21] Appl. No.: 862,761

[22] Filed: May 13, 1986

[51] Int. Cl.[4] ..... D03D 15/00; D21F 1/10

[52] U.S. Cl. ..... 139/383 A; 139/413; 139/425 A; 162/DIG. 1; 162/348

[58] Field of Search ..... 139/383 A, 383 AR, 425 A, 139/408–414; 162/DIG. 1, 348, 349, 358; 245/8

[56] References Cited

U.S. PATENT DOCUMENTS

| | | | |
|---|---|---|---|
| 4,182,381 | 1/1980 | Gisbourne | 139/383 A |
| 4,359,069 | 11/1982 | Hahn | 139/425 A |
| 4,423,755 | 1/1984 | Thompson | 139/383 A |
| 4,470,434 | 9/1984 | Vuorio | 139/425 A |
| 4,499,927 | 2/1985 | Borel | 139/425 A |
| 4,564,052 | 1/1986 | Borel | 139/425 A |
| 4,611,639 | 9/1986 | Bugge | 139/383 A |

FOREIGN PATENT DOCUMENTS 1572905 8/1980 United Kingdom .

*Primary Examiner*—James Kee Chi
*Attorney, Agent, or Firm*—Lorusso & Loud

[57] ABSTRACT

A dual layer forming fabric for use in papermaking, cellulose and similar machines having weave floats in the cross machine direction yarns on the machine side of the fabric that are under eleven machine direction yarns. The float bestows extra life potential to the fabric and gives extra protection to the machine direction yarn knuckles on the machine side of the fabric without any detrimental effect on the fine paper making surface of the fabric. The forming fabric of the present invention has a papermaking surface where the machine direction knuckles and the cross machine direction knuckles are close to, or are, coplanar.

14 Claims, 14 Drawing Figures

FIG. 4a
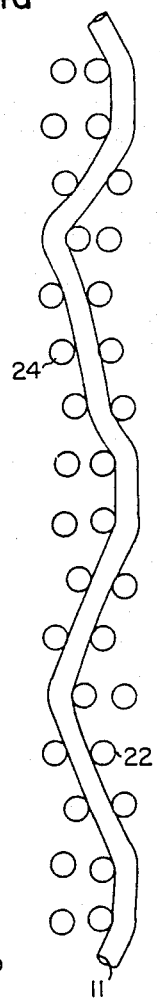
FIG. 4b
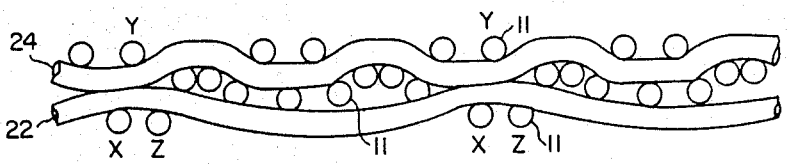
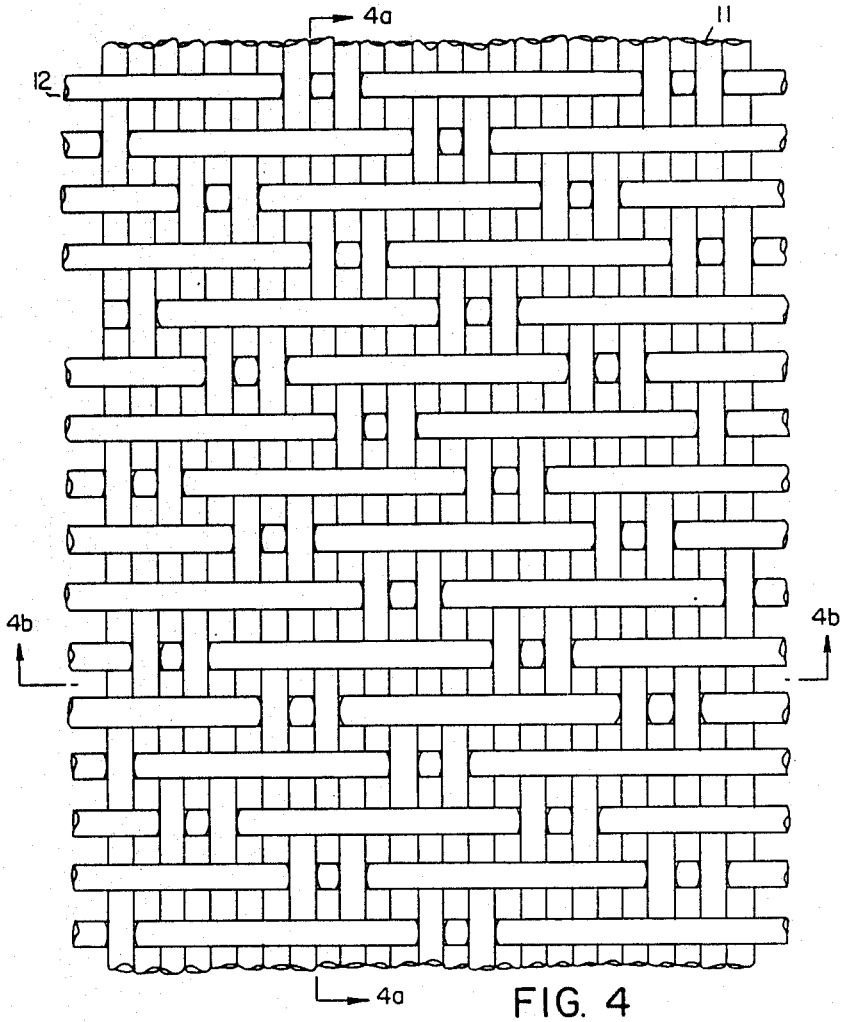
FIG. 4

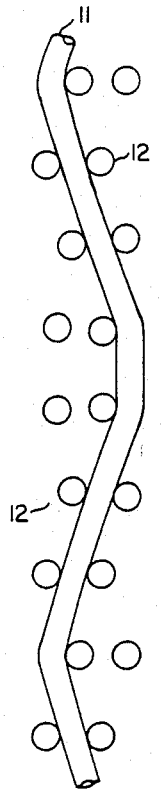
FIG. 2
(PRIOR ART)
FIG. 1d
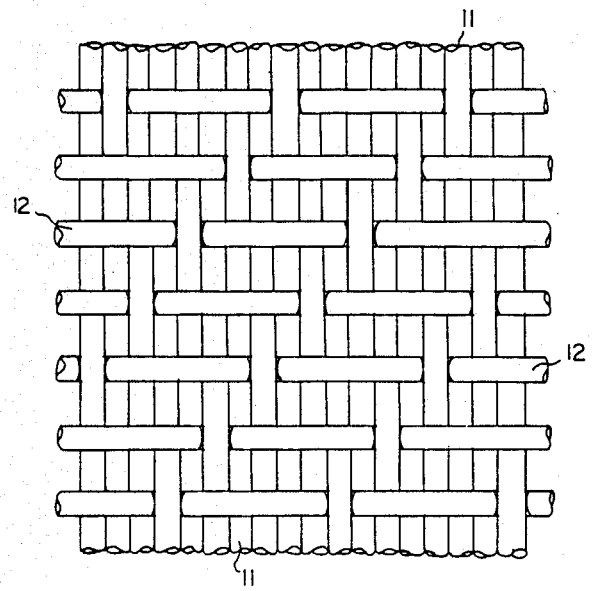

FOURTEEN HARNESS DUAL LAYER WEAVE

BACKGROUND OF THE INVENTION

The present invention relates to dual layer forming fabrics for use in papermaking, cellulose and similar machines.

Dual layer forming fabrics have only one set of machine direction yarns which bind two layers or sets of cross machine direction yarns. Each set of cross machine direction yarns is woven with a different interlacing pattern, prominent on a different side of the fabric, referred to as the sheet side and machine side of the fabric. The total width of the machine direction yarns, in relation to the total width available, referred to as machine direction cover, is usually more than 80%. The cross machine direction yarns occupy different layers. The cross machine yarns are vertically stacked so that in the case of there being an equal number of yarns in both sets, the projections of two adjacent sheet and machine side cross machine direction yarns on a horizontal plane usually overlap nearly completely. In the case of an unequal number of cross machine direction yarns in each set, this applies only for the cross machine direction yarns where their number is lower since they are not all stacked.

Dual layer papermakers' forming fabrics are manufactured in two basic ways to form an endless belt. First, they can be flat woven by a flat weaving process with their ends joined by any one of a number of well known methods to form the endless belt. Alternatively, they can be woven directly in the form of a continuous belt by means of an endless weaving process. Both methods are well known in the art and the term "endless belt" as used herein refers to belts made by either method. In a flat woven papermakers' fabric, the warp yarns extend in the machine direction and the filling yarns extend in the cross-machine direction. In a papermakers' fabric having been woven in an endless fashion, the warp yarns extend in the cross-machine direction and the filling yarns extend in the machine direction. As used herein the terms "machine direction" and "cross-machine direction" refer respectively to a direction corresponding to the direction of travel of the papermakers' fabric on the papermaking machine and a direction transverse this direction of travel.

Dual layer fabrics exhibit many advantages including an increased rigidity, extended life, improved sheet formation and mechanical stability. Even with the dual layer fabrics, however, marking has been a problem. The structure of the yarns, and/or the irregular mesh size leaves traces in the paper sheet in the form of a so-called wire marking. Early dual layer fabrics had a geometrical structure that made it impossible in practice to bring to a common plane the two yarn systems closest to the material to be formed. The difference in levels between the knuckles of the warp and weft yarns caused such a pronounced marking that these wires were useful only in forming coarse quality paper. Although with dual layer fabrics there is an improvement in wear resistance, it is generally not as much as one might expect. No known dual layer fabrics have achieved a geometry where the minimum distance of the machine direction yarns from the tangential plane of the machine side of the fabric, referred to as the machine direction yarn burial, was equal to or greater than the diameter of the machine side cross machine direction yarn. This geometry forms a fabric having what is referred to as "non-machine direction wear" condition.

SUMMARY OF THE INVENTION

The present invention is a dual layer forming fabric for use in papermaking, cellulose and similar machines having weave floats in the cross machine direction yarns on the paper machine side of the fabric that are under eleven machine direction yarns. The weave float bestows extra life potential to the fabric. The weave float is apparently formed by a double machine direction knuckle, which gives extra protection to the machine direction yarns on the machine side of the fabric. The added protection to the fabric is provided without detriment to the fine papermaking surface of the fabric. The weave produces a surface where the machine direction knuckles and the cross machine direction knuckles are close to, or are, coplanar. All of the machine directions yarns have the same weave in every repeat, which is over 28 cross machine direction yarns. More specifically, the machine direction yarns are interwoven with the cross machine direction yarns of each surface in an alternating sequence; that is to say, that after each time a machine direction yarn is interwoven with the cross machine direction yarns of one surface, it is interwoven with the cross machine direction of the other surface prior to being interwoven with the cross machine direction yarns of the first surface again.

In this manner, the wear resistance of the dual layer fabric is enhanced to a state where the machine direction yarns need not be subjected to wear at all before the cross machine direction yarns on the paper machine side of the fabric are completely worn provided that the cross machine direction yarns are originally up to approximately 50% greater in diameter than the machine direction yarns. In addition, if the cross machine direction yarns are originally up to twice the diameter of the machine direction yarns, the degree of burial of the machine direction yarns on the paper machine side of the fabric will be such that wear on the machine direction yarns may not be excessive when the cross machine direction yarns are completely worn through.

It is therefore an object of the present invention to provide a dual layer forming fabric with improved cross-machine direction wear resistance with enhanced protection to the machine direction yarns.

It is also an object of the present invention to provide a dual layer forming fabric in which the fiber support on the sheet side of the fabric is suitable for fine paper production.

These and other features and objects of the present invention will be more fully understood from the following detailed description which should be read in light of the accompanying drawings in which corresponding reference numerals refer to corresponding parts throughout the several views.

BRIEF DESCRIPTION OF THE DRAWING

FIG. 1*d* is a plan view of the machine side surface of the fabric shown in FIG. 1*a*.

FIG. 2 is a cross sectional view of another prior art 7 harness fabric, woven in a 2212 weave.

FIG. 4 is a plan view of the machine side surface of the fabric of the present invention;

FIG. 4*a* is a cross sectional view of the fabric of FIG. 4, cut along the line 4*a*—4*a* of FIG. 4; and FIG. 4*b* is a cross sectional view of the fabric illustrated in FIG. 4*a* cut along the line 4*b*—4*b* of FIG. 4.

DETAILED DESCRIPTION OF THE INVENTION

Figure 1A:
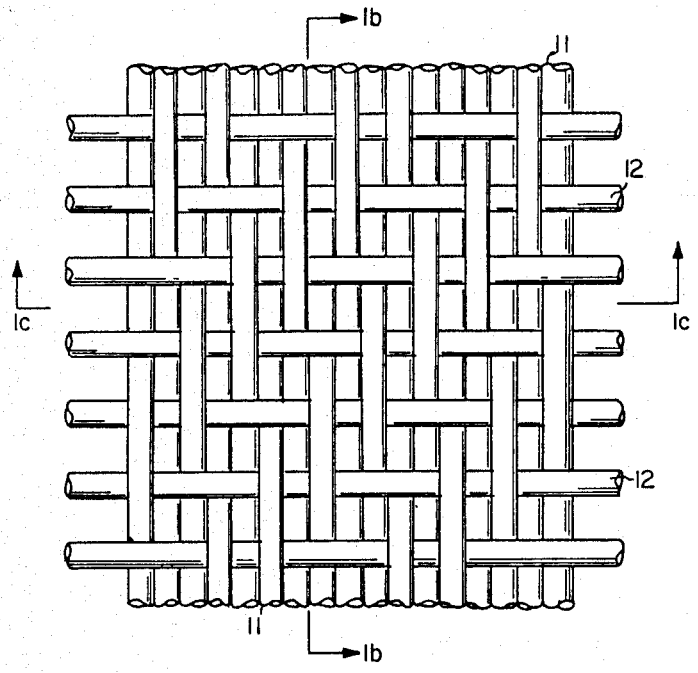
FIG. 1a (PRIOR ART)
FIG. 1*a* is a plan view of the sheet side surface of a prior art dual layer forming fabric with 7 harness 2113 weave in the machine direction yarns.
Figure 1B:
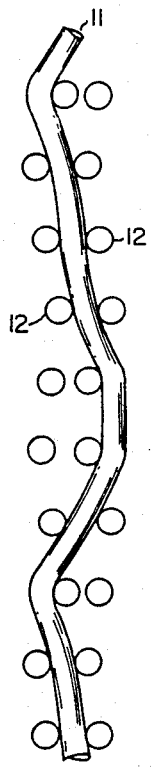
FIG. 1*b* is a cross sectional view of the fabric portrayed in FIG. 1*a*, cut along the line 1*b*—1*b* of FIG. 1*a*.
Figure 1C:
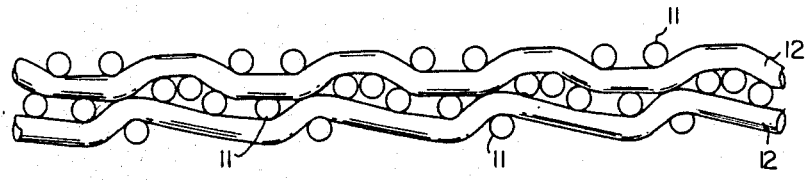
FIG. 1*c* is a cross sectional view of the fabric portrayed in FIG. 1*a*, cut along the line 1*c*—1*c* of FIG. 1*a*.

Examples of weaves of prior art dual layer forming fabrics are illustrated in FIGS. 1*a*-1*d* and 2. FIGS. 1*a*-1*d* illustrate a 2113 weave and FIG. 2 illustrates a 2212 weave. The numerical description refers to the length of the sections of the machine direction yarns 11 in different positions to the two sets of cross machine direction yarns 12. Thus, as shown in FIG. 1*b*, the machine direction yarn, 11, travels above both layers of cross machine direction yarns for two yarn counts, it goes between the cross machine direction yarn layers for 1 yarn count, it goes below both layers of cross machine direction yarns for 1 yarn count and then back up between the layers of cross machine direction yarns for 3 yarn counts. It can be illustrated the following way:

| | | | | |
|---|---|---|---|---|
| 2113 | 2 | | | above all CMD yarns |
| | | 1 | 3 | between CMD yarns |
| | | | 1 | below all CMD yarns |

Similarly, the 2212 weave of FIG. 2 can be illustrated:

| | | | |
|---|---|---|---|
| 2212 | 2 | | |
| | | 2 | 2 |
| | | | 1 |

It can be seen that the length of the repeat in each weave is the total of the numbers; thus, the 2113 and 2212 weaves each have a repeat of 7.

Figure 3C:
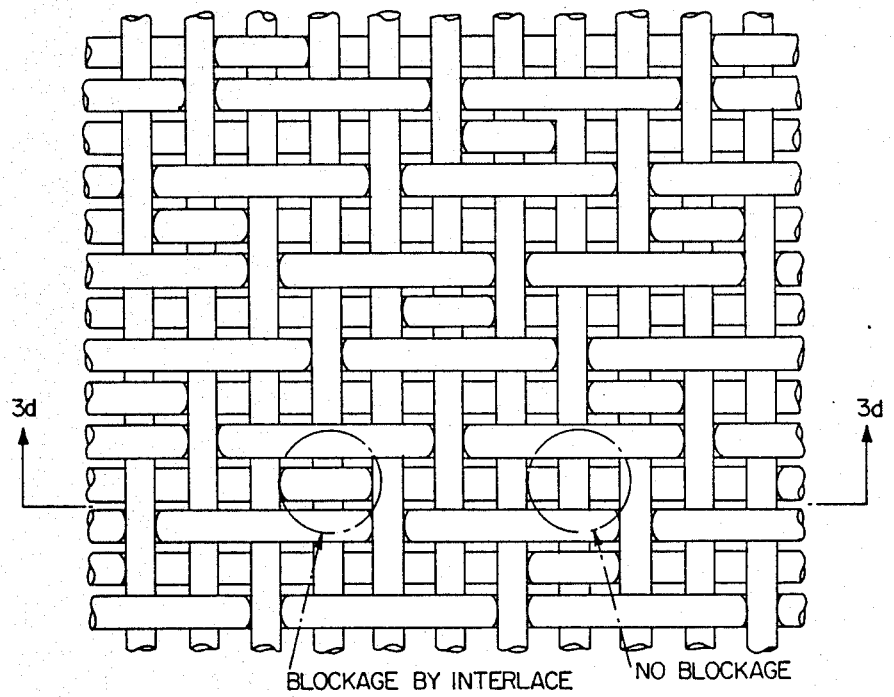
FIG. 3*c* is a weave with unstacked back filling.
Figure 3D:
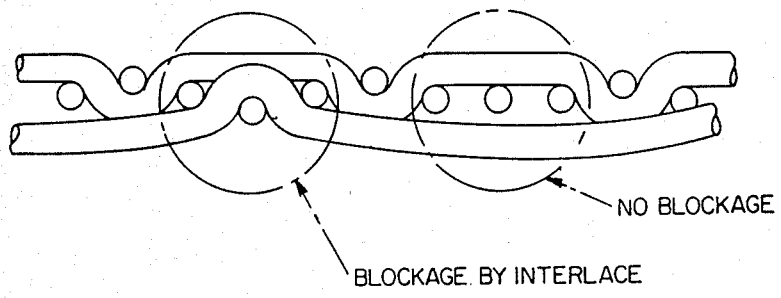
FIG. 3*d* is a cross sectional view of the weave of the fabric in FIG. 3*c* cut along line 3*d*—3*d* of FIG. 3*c*.
Figure 3A:
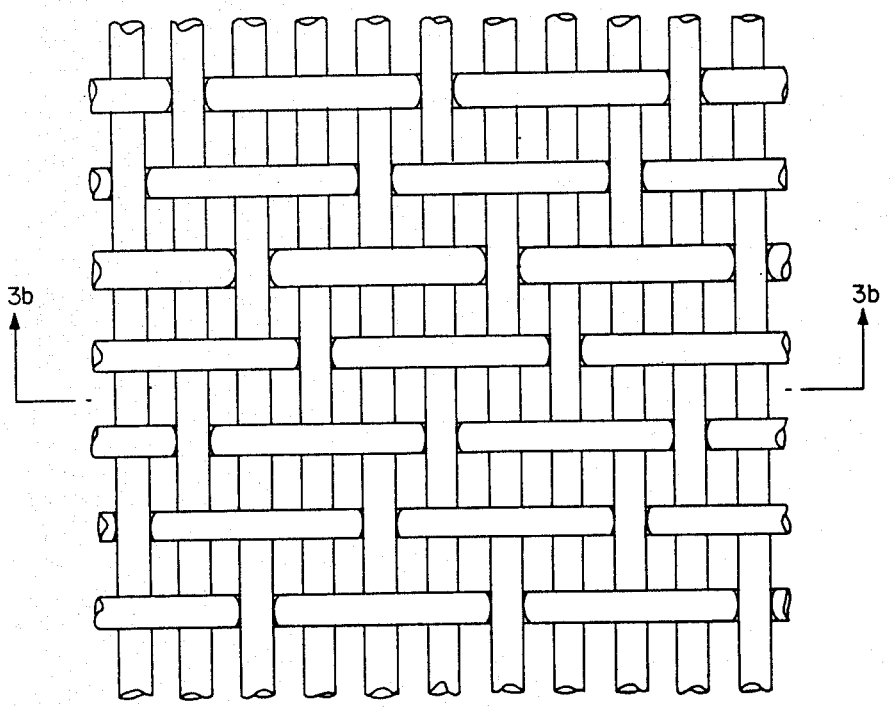
FIG. 3a (PRIOR ART)
FIG. 3*a* is a plan view of the sheet side surface of another prior art fabric, having a back filling weave with a 4 harness broken twill sheet side and an 8 harness satin machine side.
Figure 3B:
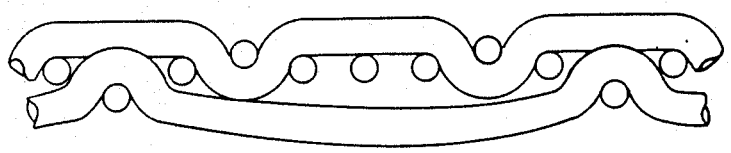
FIG. 3*b* is a cross sectional view of the weave of the the fabric in FIG. 3*a* when the fillings are not vertically stacked.

With the fabrics of FIGS. 1*a*-1*d* and FIG. 2, the interlaces of the machine side cross machine direction yarns are hidden in the same manner as in the prior art stacked back filling weave due to the vertical stacking of pairs of cross machine yarns. (See FIGS. 3*a*-3*d*). The same advantages of higher hydraulic resistance as in unstacked back filling (see FIG. 3*c*) are achieved without the blockages because of high machine direction cover. With 100% machine direction cover, for example, the projections of machine direction yarns on a horizontal plane are side by side and there are no holes through the fabric. On the other hand, the length of the weave repeats in the machine side cross machine direction yarns is limited and non machine direction wear condition may not be achievable.

As shown in FIGS. 4-4*b*, the length of the weave repeats in the machine side cross machine direction yarns, 22, is increased in the present invention by utilizing a 14 harness (14 shaft) weave rather than a 7 harness weave. By combining 2113, or its reverse 2311, and 2212, in a suitable manner into a repeat of 14, two machine direction yarns, 11, out of 14 are interwoven with each machine side cross machine direction yarn, 22, with a gap of only one machine direction yarn, 11, between these two machine direction yarns. The machine side surface of the fabric of the present invention is illustrated in FIG. 4. As shown in FIG. 4*b*, there is only one machine direction yarn (labelled Y) between the two machine direction yarns (labelled X and Z) that interlace with the same machine side cross machine direction yarn. The fact that machine direction yarn Y is on the sheet side at that point allows machine direction yarns X and Z to slide together so that their interlace appears as one double interlace. This point is further illustrated in FIG. 5*a*. Also, because yarn Y is on the sheet side, yarns X and Z can be buried further into the fabric giving protection from premature wear.

Since the weave has an equal number of cross machine direction yarns in each layer, the cross machine direction yarns can be stacked ensuring good drainage capacity. In addition, because the sheet side of the 2113 and 2212 weaves is the same as the sheet side of the combined weave, it has the same desirable papermaking characteristics as, for example, the sheet side of the fabric schematically shown in FIGS. 1*a*-1*d*, combined with the non-machine direction wear condition on the machine side.

The apparent double interlacing on the machine side of the fabric is composed of one machine direction yarn in the 2113 phase, and one machine direction yarn in the 2212 phase (see FIG. 4*a*). Because in the 2212 phase the forces are balanced so that there is no tendency towards vertical shift in stacking, the combined weave has less tendency to move from the perfectly stacked condition than that of a 2113 weave alone. It should be noted that each machine direction has the same pattern of interlacing as the adjacent machine direction yarn.

The papermaking surface of the forming fabric of the present invention has machine direction and cross machine direction knuckles which are close to, or are, coplanar.

The wear resistance of the dual layer fabric is enhanced to a state where the machine direction yarns need not be subjected to wear at all before the cross machine direction yarns on the paper machine side of the fabric are completely worn provided that the cross machine direction yarns are originally up to approximately 50% greater in diameter than the machine direction yarns. In addition, if the cross machine direction yarns are originally up to twice the diameter of the machine direction yarns, the degree of burial of the machine direction yarns on the paper machine side of the fabric will be such that wear on the machine direction yarns may not be excessive when the cross machine direction yarns are completely worn through.

As shown in FIG. 4*b* there are eleven machine direction yarns between Z and X and this eleven float feature is a characteristic of the present invention.

Figure 5A:
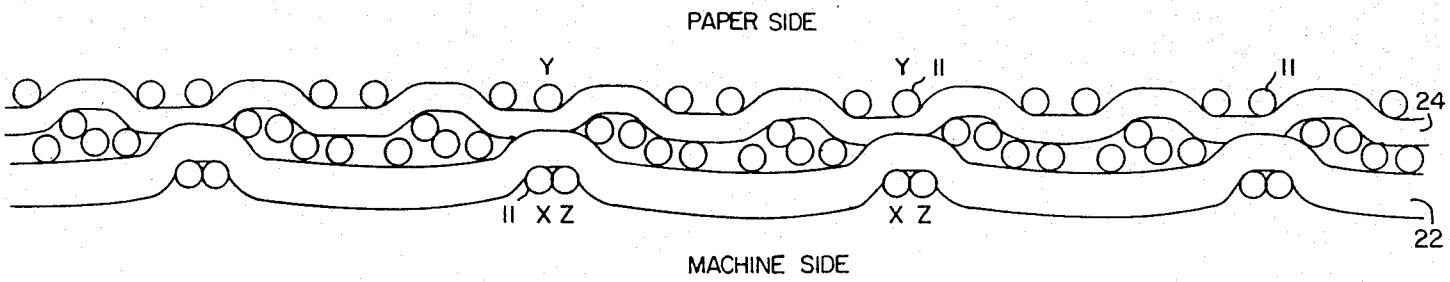
FIG. 5*a* is a cross sectional view of the fabric of the present invention portraying the two machine direction yarns on the machine side of the cross machine direction yarns coming together to form an apparent double knuckle.
Figure 5B:
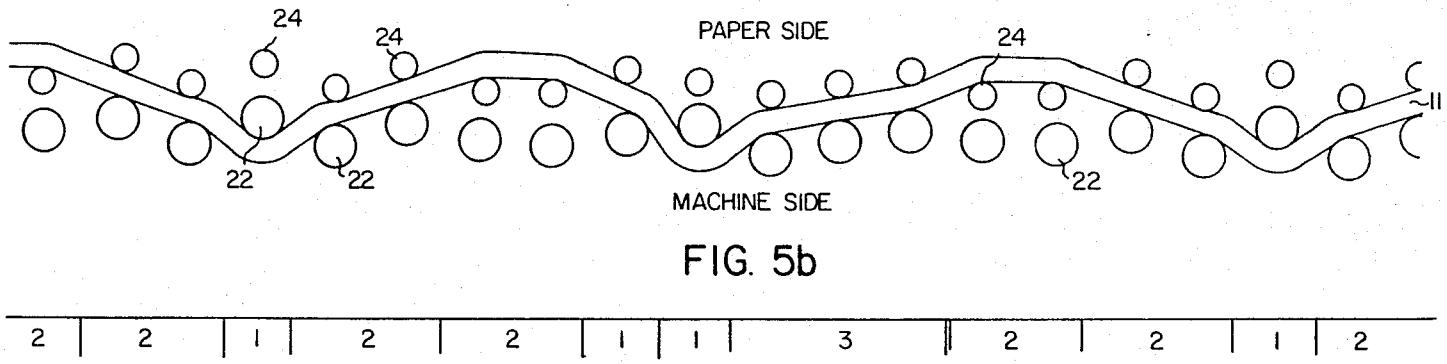
FIG. 5*b* is a cross sectional view of the fabric of the present invention portraying a machine direction yarn and clearly exhibiting the 2212 and the 2113 sections of the weave.

FIGS. 5*a* and 5*b* also show the result of increasing the cross machine direction yarn diameter on the machine side.

Naturally, such a dual layer fabric can be manufactured from monofilament yarns which are preferably synthetic yarns of materials conventionally used in such fabrics, such as polyamides, polyesters, acrylics or copolymers.

The dual layer papermakers' fabric of the present invention is superior to known papermakers' fabrics because of its various features. The fabric of the present invention has superior wearing qualities. The cross machine side cross machine direction yarns have an eleven float, which gives extra protection to the machine direction yarn knuckles on the machine side of the fabric, thereby enhancing the life of the fabric. In the combination weave repeat of 14, two machine direction yarns out of 14 are interwoven with each machine side cross machine direction yarn, with a gap of only one machine direction yarn between these two machine direction yarns. The one intermediate machine direction yarn is on the paperside of the fabric, however, thereby allowing the two machine direction yarns on the machine side to slide together to form a double interlace. In addition, because the intermediate yarn is on the sheet side, the two yarns forming the double interlace can be buried further in the fabric giving protection from premature wear.

In addition, the fabric has a good quality papermakers' surface. The papermaking surface of the fabric is preserved because the machine direction yarn knuckles and cross machine direction yarn knuckles are close to, or are, coplanar.

The forming fabric of the present invention also has good drainage capacity. There are an equal number of cross machine direction yarns in the machine side and paper side sets of cross machine direction yarns. The cross machine yarns, then, can be stacked to provide good drainage.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An improved papermakers' fabric comprising a fourteen harness dual layer endless fabric with at least 80% cover formed of machine direction and cross machine direction yarn systems having:

a set of machine direction yarns;

a first set of cross machine direction yarns located mainly on a side of the fabric facing the material to be formed and interlaced with said set of machine direction yarns in a pattern;

a second set of cross machine direction yarns located mainly on a side of the fabric facing the machine and interlaced with said set of machine direction yarns in a pattern different than the pattern of the first set of cross machine direction yarns;

a float of the interlacing pattern of the machine side cross machine direction yarn being under eleven machine direction yarns; and each machine direction yarn having the same pattern of interlacing as the adjacent machine direction yarn.

2. The papermakers' fabric of claim 1 wherein said fabric is a forming fabric.

3. The papermakers' fabric of claim 1 wherein said machine side cross machine direction yarns are comprised of polyethylene terephthalate, or polyamide, or copolymer yarns or monofilament yarn.

4. The papermakers' fabric of claim 1 wherein the distance of the machine direction yarns from the tangential plane of the surface facing the machine is approximately equal to, or greater than, the diameter of the yarns of the sheet side cross machine direction yarns, when this diameter is less than 150% of the diameter of the machine direction yarns.

5. The papermakers' fabric of claim 1 wherein two machine direction yarns, separated by one machine direction yarn, interlaces with the same machine side cross machine direction yarn.

6. An improved papermakers' fabric comprising a fourteen harness dual layer endless fabric with at least 80% cover formed of machine direction and cross machine direction yarn systems having:

a set of machine direction yarns;

a first set of cross machine direction yarns located mainly on a side of the fabric facing the material to be formed and interlaced with said set of machine direction yarns in a pattern;

a second set of cross machine direction yarns located mainly on a side of the fabric facing the machine and interlaced with said set of machine direction yarns in a pattern different than the pattern of the first set of cross machine direction yarns;

a float of the interlacing pattern of the machine side cross machine direction yarn being under eleven machine direction yarns;

each machine direction yarn having the same position of interlacing as the adjacent machine direction yarn; and two machine direction yarns, separated by one machine direction yarn, interlacing with the same machine side cross machine direction yarn.

7. The papermakers' fabric of claim 6 wherein said fabric is a forming fabric.

8. The papermakers' fabric of claim 6 wherein said machine side cross machine direction yarns are comprised of polyethylene terephthalate, or polyamide, or copolymer yarns or monofilament yarn.

9. The papermakers' fabric of claim 6 wherein the distance of the machine direction yarns from the tangential plane of the surface facing the machine is approximately equal to, or greater than, the diameter of the yarns of the sheet side cross machine direction yarns, when this diameter is less than 150% of the diameter of the machine direction yarns.

10. An improved papermakers' fabric comprising a fourteen harness dual layer endless fabric with at least 80% cover formed of machine direction and cross machine direction yarn systems having:

a set of machine direction yarns;

a first set of cross machine direction yarns located mainly on a side of the fabric facing the material to be formed and interlaced with said set of machine direction yarns in a pattern;

a second set of cross machine direction yarn located mainly on a side of the fabric facing the machine and interlaced with said set of machine direction yarns in a pattern different than the pattern of the first set of cross machine direction yarns;

a float of the interlacing pattern of the machine side cross machine direction yarn being under 11 machine direction yarns; and two machine direction yarns, separated by one machine direction yarn, interlacing with the same machine side cross machine direction yarn.

11. The papermaker's fabric claim 10 wherein said fabric is a forming fabric.

12. The papermaker's fabric of claim 10 wherein said machine side cross machine direction yarns are comprised of polyethylene terephthalate, or polyamide or copolymer yarn or monofilament yarn.

13. The papermaker's fabric of claim 10 wherein the distance of the machine direction yarns from the tangential plane of the surface facing the machine is approximately equal to, or greater than, the diameter of the yarns of the sheet side cross machine direction yarns, when this diameter is less than 150% of the diameter of the machine direction yarn.

14. The papermaker's fabric of claim 10 wherein each machine direction yarn has the same pattern of interlacing as the adjacent machine direction yarn.

* * * * *